US009352241B1

(12) United States Patent
Gast

(10) Patent No.: US 9,352,241 B1
(45) Date of Patent: May 31, 2016

(54) RUBBER BAND POWERED TOY VEHICLE

(71) Applicant: James C Gast, Gulf Breeze, FL (US)

(72) Inventor: James C Gast, Gulf Breeze, FL (US)

( * ) Notice: Subject to any disclaimer, the term of this patent is extended or adjusted under 35 U.S.C. 154(b) by 0 days.

(21) Appl. No.: 14/591,034

(22) Filed: Jan. 7, 2015

(51) Int. Cl.
*A63H 27/00* (2006.01)
*A63H 29/18* (2006.01)

(52) U.S. Cl.
CPC ..... *A63H 29/18* (2013.01)

(58) Field of Classification Search
USPC ..... 446/57, 59, 60, 61, 68
See application file for complete search history.

(56) References Cited

U.S. PATENT DOCUMENTS 935,384 A * 9/1909 Martin ..... A63H 27/02 446/58
962,172 A 6/1910 Smith
1,035,017 A * 8/1912 Kaiser ..... A63H 29/18 446/60
1,371,162 A 3/1921 Grant
1,507,192 A * 9/1924 Laukandt ..... A63H 27/005 446/60
1,738,347 A * 12/1929 Bell ..... A63H 33/20 124/26
1,803,469 A * 5/1931 Gardner ..... A63H 27/005 446/60
2,630,321 A * 3/1953 Clyne ..... F41J 9/08 273/362
2,820,321 A * 1/1958 Kuhn ..... A63H 27/00 124/62
3,222,816 A * 12/1965 Effinger, Jr. ..... A63H 27/00 446/60
3,616,567 A 11/1971 Goodman
3,713,249 A * 1/1973 Goodman ..... A63H 29/18 446/162
3,754,349 A * 8/1973 Wallace ..... A63H 27/00 446/163
3,787,997 A 1/1974 Lemelson
3,952,448 A 4/1976 Kabchef
4,280,298 A 7/1981 Kulzer
4,674,986 A 6/1987 Ueda
4,895,541 A 1/1990 Miller
5,364,298 A 11/1994 Crisci et al.
5,395,275 A * 3/1995 Johnson ..... A63H 29/18 446/429
5,947,785 A 9/1999 Bausch
6,349,902 B1 * 2/2002 Cripe ..... A63H 27/08 244/153 R
6,948,997 B2 9/2005 Gregory
7,244,162 B2 7/2007 Tsai et al.

* cited by examiner

*Primary Examiner* — Melba Bumgarner
*Assistant Examiner* — Joseph B Baldori

(57) ABSTRACT

A rubber band powered toy vehicle uses the stored energy of a twisted rubber band to power a propeller during vehicle travel, either airborne flight or water borne travel. The vehicle has a slide tube attached to its underside which is slidably disposed along a main tube, the main tube having the rubber band passing therethrough. Prior to flight, the slide tube and its attached vehicle are slid rearwardly along the main tube until stopped by a positioning ring. Once the vehicle is released for travel, the rubber band untwists providing energy for rotation of the propeller. When the vehicle crashes, either during a crash landing into the ground or crashing in flight into an object, the slide tube and its attached vehicle slide forwardly along the main tube in order to act as a shock absorber for the crash in order to help protect the components of the toy.

9 Claims, 5 Drawing Sheets

RUBBER BAND POWERED TOY VEHICLE

BACKGROUND OF THE INVENTION

1. Field of the Invention

The present invention relates to a flying toy vehicle that uses a rubber band powered propeller and that has shock absorption capabilities for landing.

2. Background of the Prior Art

Flying toy airplanes using a rubber band as a power source has been enjoyed by kids (and adults) for many years. Basically, a toy airplane has a bearing laden shaft that holds propeller at the front with a rubber band having an end attached to the propeller and an opposing end attached proximate the aft of the airplane in appropriate fashion. The propeller is rotated in a direction opposite the direction of rotation of the propeller for flight, which rotation causes the rubber band to twist and thereby store energy. When the airplane's propeller is released and the airplane is sent aloft, the rubber band releases its stored energy by untwisting which causes the propeller to rotate and thereby power the airplane down range, allowing relatively long airborne times and flight distances to be achieved, especially for planes that use a quality, correctly sized rubber band. Once the airplane impacts an object or crash lands, the process is repeated.

Such powered rubber band airplane flying is considerable fun, however, certain shortcomings are noted. As it is the desire to keep the airplane airborne as long as possible, the airplane is kept as light as possible, typically being made with a thinly designed balsa wood, Styrofoam, etc. Once the airplane loses its ability to maintain level flight and to stay aloft, the airplane crashes into the ground or other surface. The impact of such a crash can be quite destructive due to a fast in air speed of flight, especially if a high altitude was achieved prior to the crash landing. Such crashes and crash landings impact considerable stress onto the airplane especially onto the flight control surfaces and the propeller shaft bent no longer spinning true, which often absorbs a large portion of the energy of the crash. Such stress can cause damage to the airplane. As these types of airplanes are made from lightweight materials the result is that the lifespan of many of these types of toys is not very long.

What is needed is a rubber band powered sport wing toy airplane that helps dissipate the energy of a crash landing or a crash into an object during flight so as to reduce the stress impacted onto the airplane's propeller and wing structure and thereby help increase the lifespan of the wing sport toy. Such an airplane must be made from lightweight materials so as not to adversely impact flight time and distance of the sport wing airplane toy and should be of relatively simple construction.

SUMMARY OF THE INVENTION

The rubber band powered toy vehicle of the present invention addresses the aforementioned needs in the art by providing a vehicle (which can be an airplane, a submarine for underwater use, a sports ball, a superhero sports figurine, etc.,) that uses a shock absorber to absorb the impact occasioned onto the toy during crash landings and crashes into other objects. The rubber band powered toy vehicle is lightweight yet sturdy, allowing relatively long flight times and flight distances to be achieved. The rubber band powered toy vehicle is of simple design and construction being produced using standard manufacturing techniques. The specific airplane body used with the present invention can quickly and easily removed from the engine of the toy and swapped out for a different aircraft body style or even to a different vehicle type such as a submarine body for use of the rubber band powered toy vehicle under water (the airplane body version of the vehicle can also be used under water).

The rubber band powered toy vehicle of the present invention is comprised of a main tube that has a forward end and an aft end. A notched connector tube is attached to the aft end of the main tube. A propeller is attached to the forward end of the main tube. A rubber band is attached to the propeller and is also attached to the connector tube, such that rotation of the propeller causes the rubber band to twist and thereby store energy. A slide tube is slidably disposed along the main tube. A vehicle is attached to the slide tube. A positioning ring encircles the main tube and is positioned between the slide tube and the aft end of the main tube and is capable of sliding along the main tube. A stabilizer tube is attached to the main tube proximate the aft end thereof while a fuselage tube is attached to the vehicle such that a portion of the stabilizer tube is received within the fuselage tube whenever the slide tube is slid toward the aft end of the main tube. The slide tube is attached to the vehicle via the fuselage tube. The vehicle may be attached to the slide tube via a clip which may be spring-loaded. A friction ring may encircle the slide tube.

BRIEF DESCRIPTION OF THE DRAWINGS

Similar reference numerals refer to similar parts throughout the several views of the drawings.

DESCRIPTION OF THE PREFERRED EMBODIMENT

Figure 1:
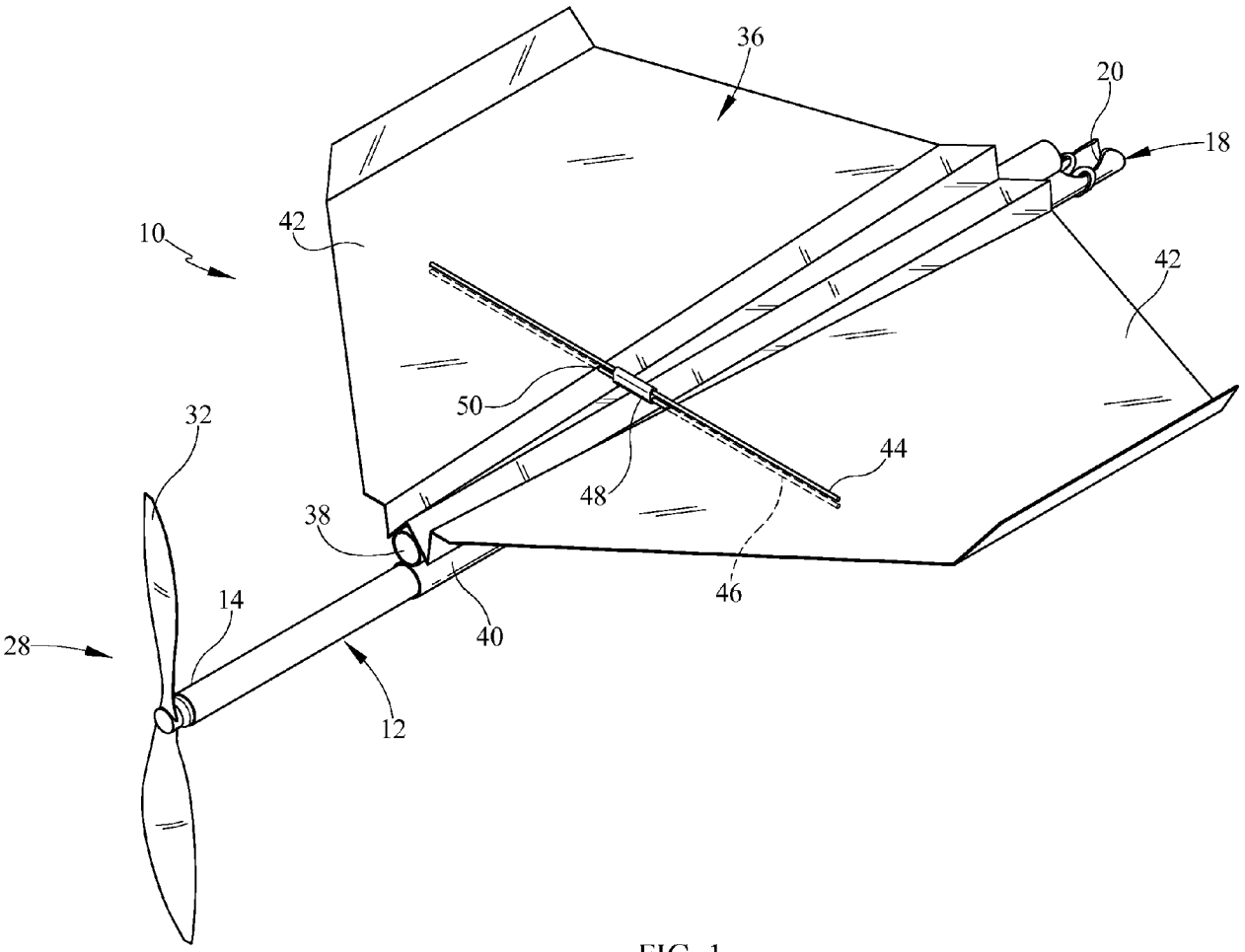
FIG. 1 is a perspective view of the rubber band powered toy vehicle of the present invention.
Figure 2:
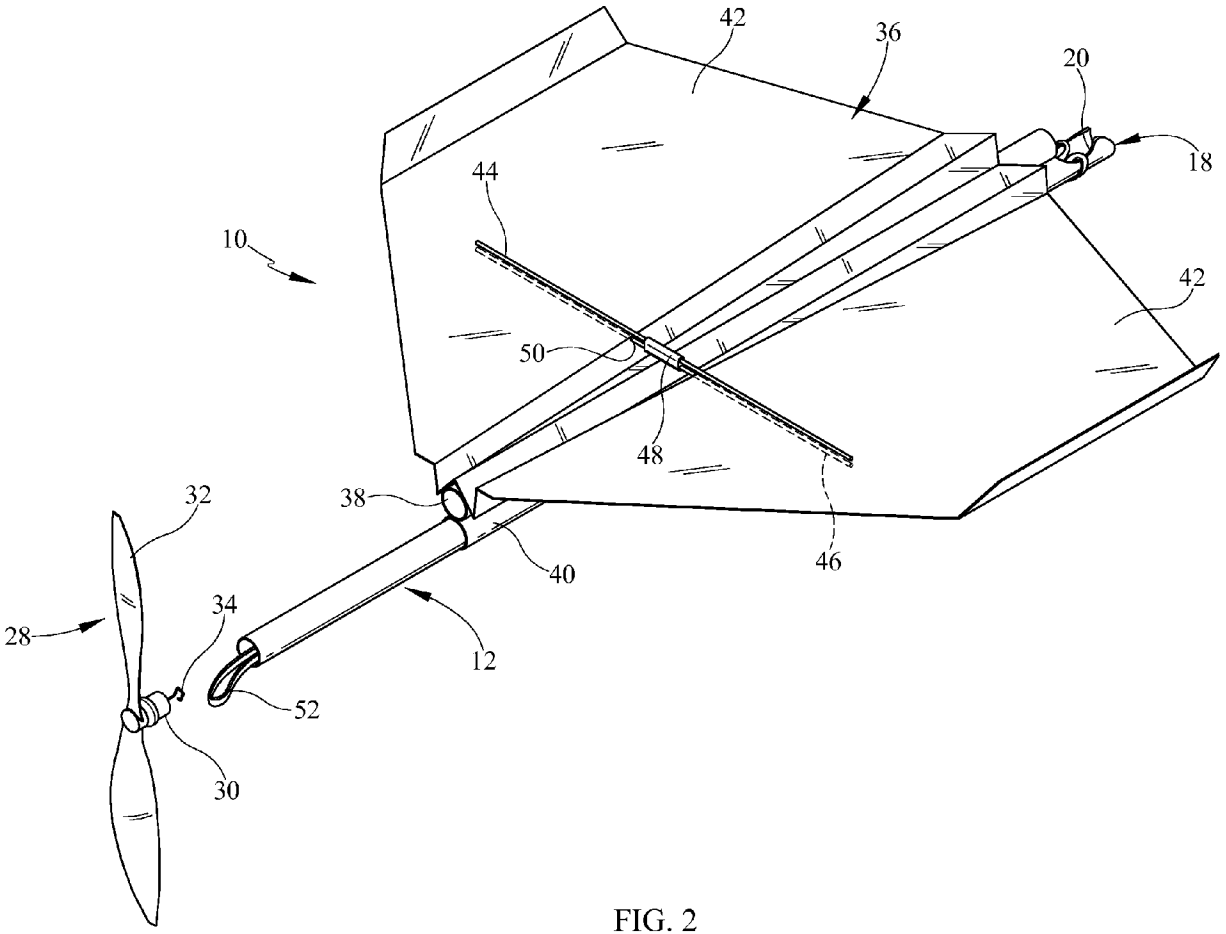
FIG. 2 is a perspective view of the rubber band powered toy vehicle with the propeller removed.
Figure 3:
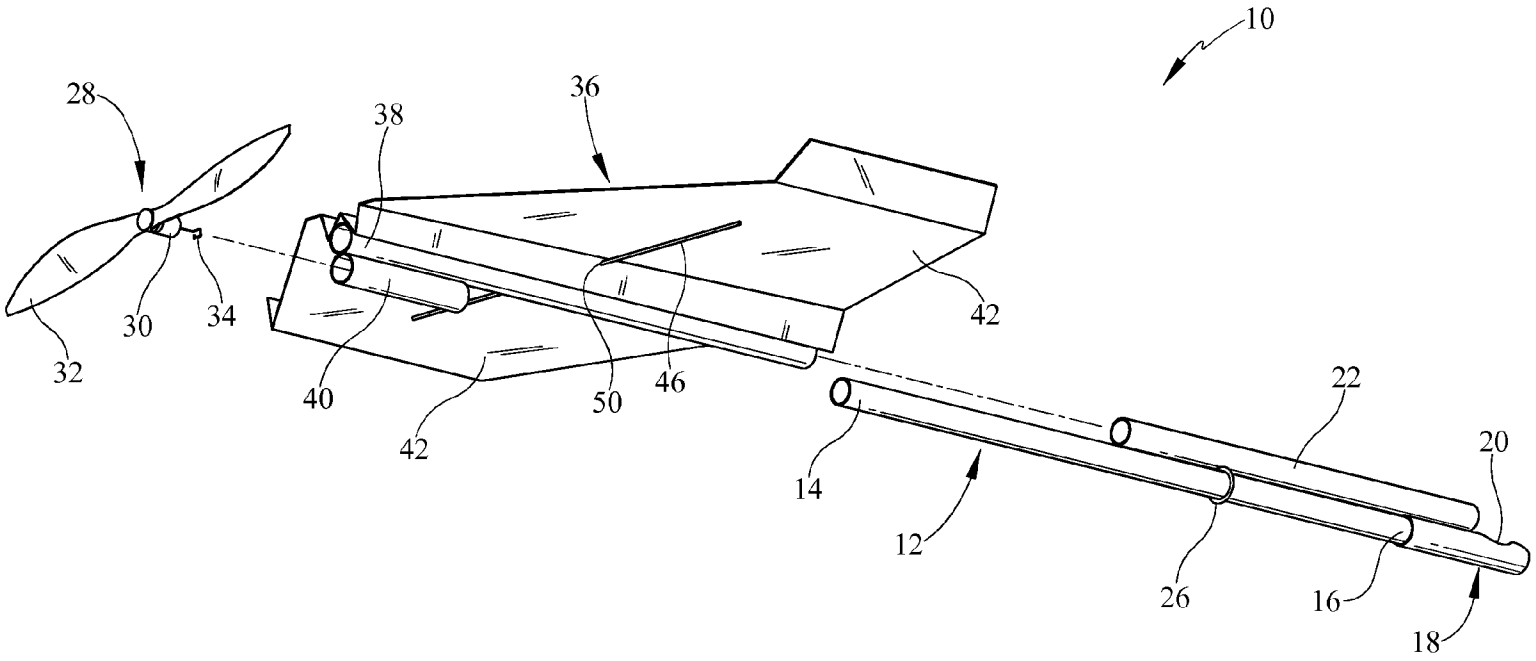
FIG. 3 is a lower perspective view, partially exploded, of the rubber band powered toy vehicle.
Figure 4:
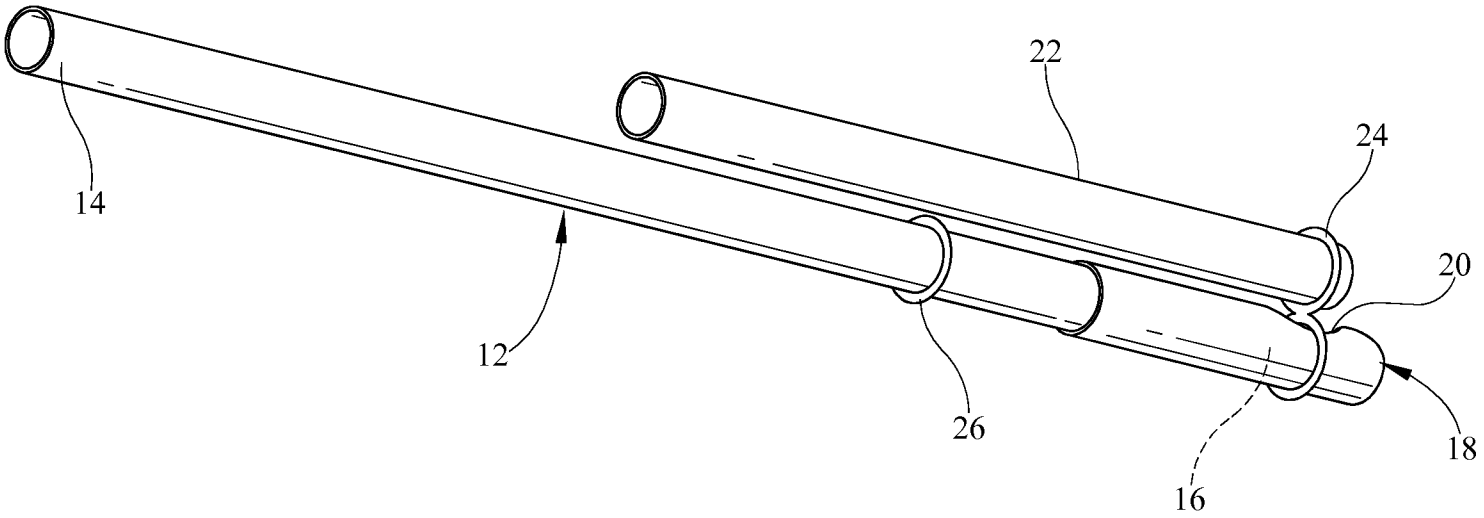
FIG. 4 is a perspective view of the fuselage of the rubber band powered toy vehicle using a dual ring to attach stabilizer tube to the rear connector tube.

Referring now to the drawings, it is seen that the rubber band powered toy vehicle of the present invention, generally denoted by reference numeral 10, is comprised of a main tube 12 having a forward end 14 and an aft end 16. A rear connector tube 18 having a notched portion 20 is removably attached to the aft end 16 of the main tube 12. A stabilizer tube 22 is attached to the rear connector tube 18 in appropriate fashion such as via the use of an adhesive, as illustrated in FIG. 3, or via a dual ring connector 24, as illustrated in FIG. 4. A positioning ring 26 encircles the main tube 12 and is capable of sliding along the length of the main tube 12.

A propeller assembly 28 has a hub 30 and a propeller 32 that is rotatably attached to the hub 30 via an appropriate bearing. A hook 34 is attached to the propeller 32 and rotates in lockstep with the propeller 32.

A vehicle 36 which can have any desired form, such as the illustrated airplane (submarine, sports ball, etc.,), is provided such that a fuselage tube 38 is attached to the underside of the vehicle 36 in any appropriate fashion. A slide tube 40 is attached to the fuselage tube 38 in appropriate fashion proximate the forward end of the vehicle 36. If the vehicle 36 is configured as an airplane 36, I have found that the use of thin sheet flexible plastic works well for such a configuration. As the wings 42 of the aircraft tend to flop about during flight, an upper spar 44 is positioned overtop the wings 42 while a lower spar 46 is positioned underneath the wings 42. The two spars 44 and 46 are held in close proximity to one another via the use of a small dual tubed connector 48 and are held onto the aircraft by passing the lower spar 46 through a pair of openings 50 located on the sides of either wing 42. Of course, other airplane configurations can be used including swept wing, straight wing, bi-wing, etc. As noted earlier, the vehicle may have configurations other than an aircraft configuration such as a submarine for underwater use, a sports ball such as a football, a flying disk, etc., the main consideration be that the vehicle is relatively lightweight and aerodynamic for airborne flight or hydrodynamic for water travel.

The various tubes, including the main tube 12, the connector tube 18, the stabilizer tube 22, the fuselage tube 38 and the slide tube 40 can be made from a thin plastic and can be made using ordinary straws with the connector tube 18 being an end of a typical spoon straw. The positioning ring 26 is a rubber O-ring.

In order to assemble the rubber band powered toy vehicle 10 of the present invention, the vehicle 36 is attached to the main tube 12 by sliding the slide tube 40 onto the main tube 12 via the main tube's forward end 14. The vehicle 36 is slid along the main tube 12 until the fuselage tube 38 receives a portion of the stabilizer tube 22. The positioning ring 26 acts as a stop for the vehicle 36 along the main tube 12. A rubber band 52 is attached to the hook 34 of the propeller assembly 28 and the rubber band 52 passed through the main tube 12. The propeller assembly 28 is attached to the forward end 14 of the main tube 12 by capping the hub 30 into the forward end 14 of the main tube 12 with the hook 30 and its attached rubber band 52 within the main tube 12, the hub 30 being held within the main tube 12 via friction. The rear connector tube 18 is attached to the aft end 16 of the main tube 12 and the rubber band 52 is attached to the connector tube 18 in appropriate fashion, such as tying or twisting the rubber band 52 within the notch 20 of the connector tube 18—it is expressly recognized that the rubber band 52 can be attached to the rubber band powered toy vehicle 10 via means other than the use of a connector tube 18. The rubber band 52 is sized to correspond to the length of the main tube 12. The rubber band powered toy vehicle 10 is ready for use. The propeller 32 is rotated in a direction opposite to the direction of rotation of the propeller 32 during flight. Rotation of the propeller 32 causes the rubber band 52 to twist and thereby store energy. Once the rubber band 52 is sufficiently twisted, the rubber band powered toy vehicle 10 is released, typically by throwing the rubber band powered toy vehicle 10 if it is being used for airborne flight or simply being released for water borne travel. As the rubber band powered toy vehicle 10 is released, the rubber band 52 begins to untwist causing the propeller 32 to rotate and thereby power the rubber band powered toy vehicle 10 through its travel. The stabilizer tube 22 being partially received within the fuselage tube 38 helps steady the vehicle 36 during travel and prevent vehicle roll about the main tube 12. Once the rubber band powered toy vehicle 10, in airborne flight, loses its lift it crashes to the ground or simply crashes into an object during flight. The impact of the crash causes the slide tube 40 and its attached mass of the vehicle 36 and the fuselage tube 38 to slide forward along the main tube 12 until stopped by the propeller assembly 28 (or even pushing the propeller assembly 28 out of its attachment with the main tube 12) thereby absorbing a sizable portion of the crash energy and helping protect the components of the rubber band powered toy vehicle 10. The sliding of the slide tube 40 along the main tube 12 during the crash event also causes the fuselage tube 38 to frictionally slide along the positioning ring further helping dissipate the energy of the crash. Thereafter, the slide tube 38 is slid back along the main tube 12 toward the aft end 16 thereof, until stopped by the positioning ring 26. The position of the positioning ring 26 can be adjusted as needed based on determining the ideal position of the vehicle 36 along the main tube 12 which can be determined via a few test flights. When the rubber band 52 breaks, the broken rubber band 52 is detached from the connector tube 18 and unhooked from the hook 34 of the propeller assembly 28 and replaced with a new rubber band 52.

Figure 5:
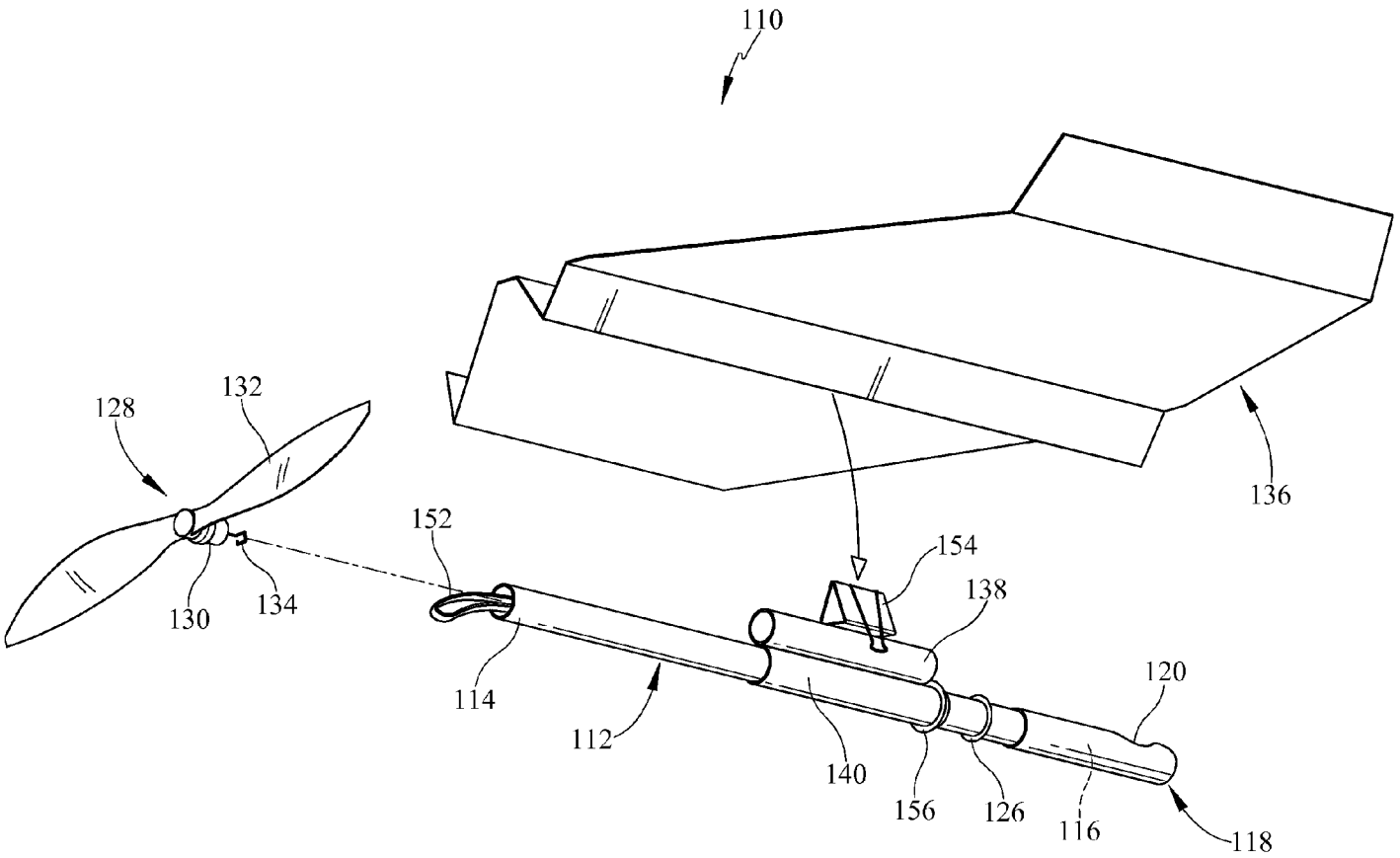
FIG. 5 is a perspective view of an alternate embodiment of the rubber band powered toy vehicle of the present invention.

As seen in FIG. 5, in an alternate embodiment of the rubber band powered toy vehicle 110 of the present invention, a main tube 112 has a forward end 114 and an aft end 116. A rear connector tube 118 having a notched portion 120 is removably attached to the aft end 116 of the main tube 112. A positioning ring 126 encircles the main tube 112 and is capable of sliding along the length of the main tube 112.

A propeller assembly 128 has a hub 130 and a propeller 132 that is rotatably attached to the hub 130 via an appropriate bearing. A hook 134 is attached to the propeller 132 and rotates in lockstep with the propeller 132.

A vehicle 136 which can have any desired form, such as the illustrated paper airplane (submarine, sports ball, etc.,), is provided such that a fuselage tube 138 is attached to a slide tube 140 in appropriate fashion. A clip 154 is attached to the fuselage tube (strictly speaking, the fuselage tube 138 is not needed and the clip 154 can be attached directly to the slide tube 140, however, the use of a fuselage tube 138 raises the vehicle 136 a sufficient height above the main tube 112 and helps prevent contact between the two during flight and during crashes). A friction ring 156 encircles the slide tube 140 and acts as a friction point to help control pre-set flight position. When the rubber band powered toy vehicle 110 crashes, the friction ring 156 controls the release impact inertia of the crash and helps prevent damage to the rubber band powered toy vehicle 110.

The various tubes, including the main tube 112, the connector tube 118, the fuselage tube 138 and the slide tube 140 can be made from a thing sheet plastic and can be made using ordinary straws with the connector tube 118 being an end of a typical spoon straw. The positioning ring 126 and the friction ring 156 are each rubber O-rings.

In order to assemble the alternate embodiment of the rubber band powered toy vehicle 110 of the present invention, the vehicle 136 is attached to the main tube 112 by sliding the slide tube 140 onto the main tube 112 via the main tube's forward end 114 and clipping a vehicle 136 to the fuselage tube 138 (or to the slide tube 140) via the clip 154. The vehicle 136 is slid along the main tube 112 until stopped by the positioning ring 126. A rubber band 152 is attached to the hook 134 of the propeller assembly 128 and the rubber band 152 is passed through the main tube 112. The propeller assembly 128 is attached to the forward end 114 of the main tube 112 by capping the hub 130 into the forward end 114 of the main tube 112 with the hook 130 and its attached rubber band 152 within the main tube 112, the hub 130 being held within the main tube 112 via friction. The rear connector tube 118 is attached to the aft end 116 of the main tube 112 and the rubber band 152 is attached to the connector tube 118 in appropriate fashion, such as tying or twisting the rubber band 152 within the notch 120 of the connector tube 118—it is expressly recognized that the rubber band 152 can be attached to the rubber band powered toy vehicle 110 via means other than the use of the connector tube 118. The rubber band 152 is sized to correspond to the length of the main tube 112. The rubber band powered toy vehicle 110 is ready for use. The propeller 132 is rotated in a direction opposite to the direction of rotation of the propeller 132 during flight. Rotation of the propeller 132 causes the rubber band 152 to twist and thereby store energy. Once the rubber band 152 is sufficiently twisted, the rubber band powered toy vehicle 110 is released, typically by throwing the rubber band powered toy vehicle 110 if it is being used for airborne flight or simply being released for water borne travel. As the rubber band powered toy vehicle 110 is released, the rubber band 152 begins to untwist causing the propeller 132 to rotate and thereby power the rubber band powered toy vehicle 110 through its travel. Once the rubber band powered toy vehicle 110 in airborne flight loses its lift, it crashes to the ground or simply crashes into an object during flight. The impact of the crash causes the slide tube 140 and its attached mass of the vehicle 136 and the fuselage tube 138 to slide forward along the main tube 112 until stopped by the propeller assembly 128 (or even pushing the propeller assembly 128 out of its attachment with the main tube 112) thereby absorbing a sizable portion of the crash energy and helping protect the components of the rubber band powered toy vehicle 110. Thereafter, the slide tube 138 is slid back along the main tube 112 toward the aft end 116 thereof, until stopped by the positioning ring 126. The position of the positioning ring 126 can be adjusted as needed based on determining the ideal position of the vehicle 136 along the main tube 112 which can be determined via a few test flights. When the rubber band 152 breaks, the broken rubber band 152 is detached from the connector tube 118 and unhooked from the hook 134 of the propeller assembly 128 and replaced with a new rubber band 152.

While the invention has been particularly shown and described with reference to embodiments thereof, it will be appreciated by those skilled in the art that various changes in form and detail may be made without departing from the spirit and scope of the invention.

I claim:

1. A powered flying toy comprising:

a main tube having a forward end and an aft end;

a propeller attached to the forward end of the main tube;

a rubber band attached to the propeller and also attached to the main tube proximate the aft end such that rotation of the propeller causes the rubber band to twist;

a slide tube slidably disposed along the main tube;

a vehicle attached to the slide tube; a positioning ring encircling the main tube and positioned between the slide tube and the aft end and capable of sliding along the main tube; a stabilizer tube attached to the main tube proximate the aft end thereof; and a fuselage tube attached to the vehicle such that a forward portion of the stabilizer tube is received within the fuselage tube whenever the slide tube is slid down toward the aft end of the main tube.

2. The powered flying toy as in claim 1 wherein the slide tube is attached to the vehicle via the fuselage tube.

3. The powered flying toy as in claim 1 wherein the vehicle is attached to the slide tube via a clip.

4. The powered flying toy as in claim 3 wherein the clip is spring-loaded.

5. The powered flying toy as in claim 3 further comprising a friction ring encircling the slide tube.

6. A powered flying toy comprising:

a main tube having a forward end and an aft end;

a notched connector tube attached to the aft end of the main tube;

a propeller attached to the forward end of the main tube;

a rubber band attached to the propeller and also attached to the connector tube such that rotation of the propeller causes the rubber band to twist;

a slide tube slidably disposed along the main tube;

a vehicle attached to the slide tube; a positioning ring encircling the main tube and positioned between the slide tube and the aft end and capable of sliding along the main tube; a stabilizer tube attached to the main tube proximate the aft end thereof; and a fuselage tube attached to the vehicle such that a forward portion of the stabilizer tube is received within the fuselage tube whenever the slide tube is slid down toward the aft end of the main tube.

7. The powered flying toy as in claim 6 wherein the slide tube is attached to the vehicle via the fuselage tube.

8. The powered flying toy as in claim 6 wherein the vehicle is attached to the slide tube via a clip.

9. The powered flying toy as in claim 8 further comprising a friction ring encircling the slide tube.

* * * * *